United States Patent [19]

Garrison

[11] 4,114,201

[45] Sep. 19, 1978

[54] VENTILATED HEAD COVER

[76] Inventor: Harold K. Garrison, 1010 Grove Blvd. Apt #105, Austin, Tex. 78741

[21] Appl. No.: 796,313

[22] Filed: May 12, 1977

[51] Int. Cl.[2] ..... A42B 5/04

[52] U.S. Cl. ..... 2/209.7

[58] Field of Search ..... 2/171.1, 209.7, 181.2, 2/10, 182.3, 182.1, 209.3, 177

[56] References Cited

U.S. PATENT DOCUMENTS

| | | | |
|---|---|---|---|
| 1,036,004 | 8/1912 | Revell | 2/184.5 |
| 1,133,934 | 3/1915 | Collins | 2/181112 |
| 3,925,821 | 12/1975 | Lewicki | 2/425 |

*Primary Examiner*—Doris L. Troutman

*Attorney, Agent, or Firm*—Pravel, Wilson & Gambrell

[57] ABSTRACT

The present invention pertains to a ventilated head cover having a plurality of openings in the crown and also between the brim of the head cover and the sweatband and/or between the sweatband and the wearer's head to permit air to freely circulate up into and out of the crown to cool the head of the wearer. Further, the openings in the crown are shaded with an overhanging or outwardly projecting bill or bills which extend outwardly to provide a shade or sunlight barrier to exclude direct sunlight from the wearer's head.

8 Claims, 12 Drawing Figures

VENTILATED HEAD COVER

BACKGROUND OF THE INVENTION

There have been various types of head cover provided in the past to keep sunlight off the wearer's head and certain of these devices have also been provided with ventilated openings to permit the circulation of air into and out of the head cover. Some of these devices have provided openings in the side of the crown of the hat, such as shown and described in the patents to Cleary, U.S. Pat. No. 1,009,281; to Swanson U.S. Pat. No. 1,062,668; and to Hawkins, U.S. Pat. No. 504,350. One convertible hat disclosed in the patent to Coyne, U.S. Pat. No. 1,187,507, has provided a suspended hatband having a plurality of circumferentially spaced lugs for contacting the wearer's head at spaced points around the perimeter of the head and thereby providing small air spaces for the entrance of air to the head.

It is an object of the present invention to provide a ventilated head cover having a plurality of shaded openings around the crown of the hat together with a plurality of circumferentially spaced passages at the hatband for permitting free circulation of air up into and out of the hat around the area of the wearer's head normally contacted by the hatband and also to provide openings for free circulation or ventilation of air into, across, around, and out of the area between the hat and the wearer's head.

FIELD OF THE INVENTION

The present invention pertains to head covers and particularly to ventilated head cover for providing air circulation in, across and around the wearer's head with direct sun rays substantially restricted.

SUMMARY OF THE INVENTION

The present invention pertains to hats with ventilated crowns and sweatbands and having laterally projecting sun shades above the ventilation openings in the crown to restrict direct entry of sun rays into the crown.

DESCRIPTION OF THE PREFERRED EMBODIMENT

Figure 1:
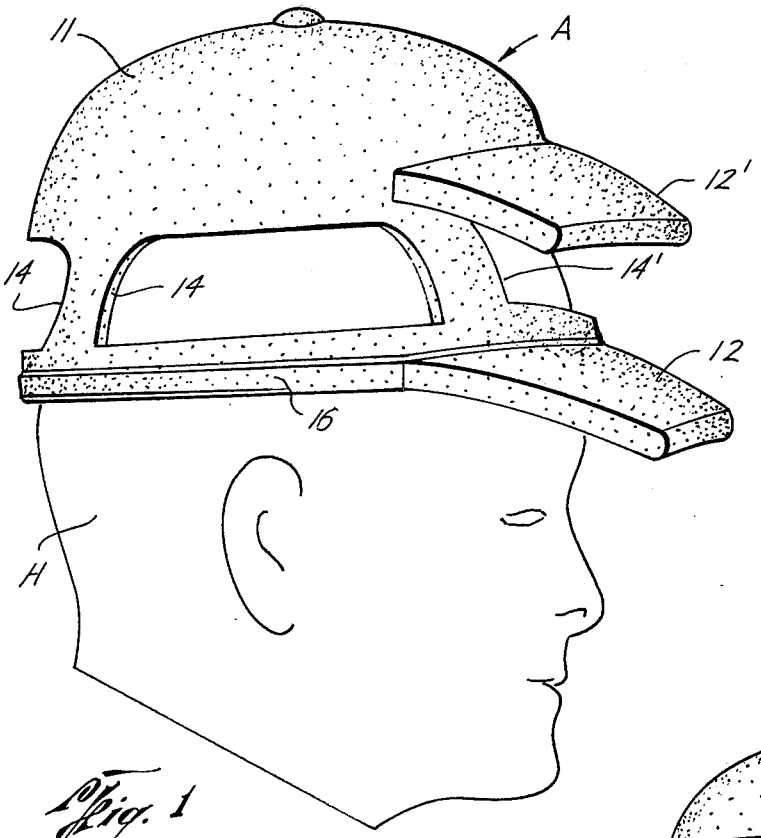
FIGS. 1 and 1A are side views of a ventilated head cover of the present invention shown on the head of a wearer.

As shown in FIG. 1 of the drawings, the cap-type head cover A is positioned on a person's head H. Such cap-type structure includes a crown 11 and a bill 12 which projects over the forehead of the wearer. The crown 11 is provided with a plurality of circumferentially extending openings or air passages 14 which are positioned around the crown to provide a ventilation space to permit air to enter the crown from either side or from the front or rear and to flow freely across the head H of the wearer. Further, as shown in FIG. 1, a second bill 12' is positioned above the bill 12 so as to shade the front ventilation opening 14' in the crown 11 and thus restrict substantially the entrance of direct rays of sun from entering the crown and falling on the front of the head H.

Figure 1A:
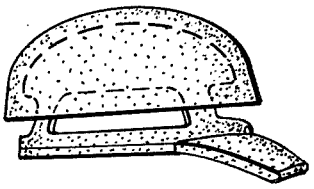
Figure 2:
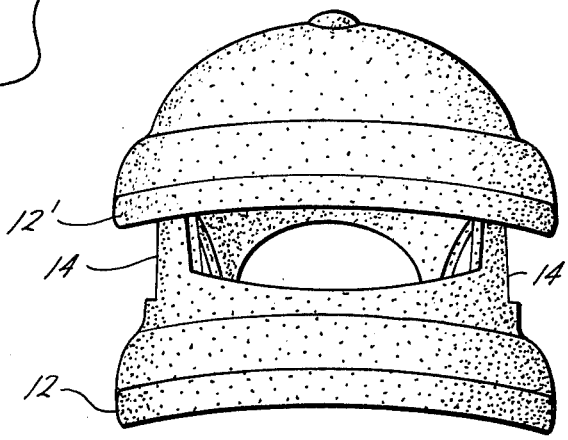
FIG. 2 is a front view of the cap shown in FIG. 1 showing additional details of its construction.

As shown in FIG. 2 of the drawings, the ventilation openings 14 are positioned on opposite sides of the crown so as to permit substantially straight through-flow of air from one side of the hat to the other to provide cross-ventilation in the crown. The air flow is thus impeded only by that portion of the wearer's head which may extend between the ventilation passages when the hat is worn. Also, there are ventilation openings in the front and rear of the crown. Further, as best shown in FIG. 2 of the drawings, the bill 12' is positioned so as to be aligned substantially with the opening 14' and also with the lower bill 12 which projects forwardly from the hatband area 16 of the cap A. If desired, the upper bill 12' can extend around the entire circumference of the crown or some selected portion thereof as shown in FIG. 1*a*.

Figure 3:
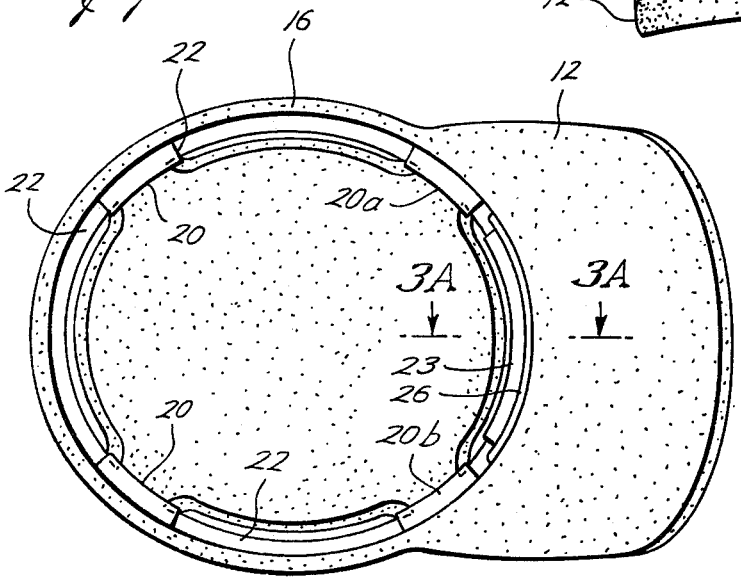
FIG. 3 is a bottom view of the cap illustrated in FIG. 1 showing ventilation means around the sweatband of the cap.
Figure 3A:
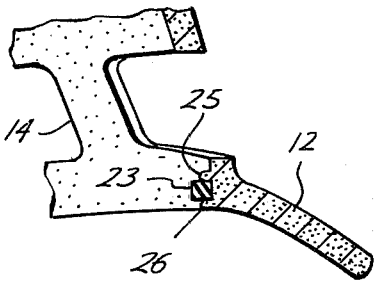

As shown in FIG. 3 of the drawings, a plurality of elongated hatband projections 20 are provided at circumferentially spaced points around the circumference of the hatband area 16 to provide contact with the head of the wearer at intermittent spaced points around the circumference of the cap A. It will be appreciated that annular spaces 22 are provided between each of the adjacent elongated projections 20 to provide a passageway to permit the circulation of air up, in, and out of the cap A as well as around the head of the wearer. With this arrangement, air can pass between the hatband area and the head of the wearer as well as into and out of the cap A on either side of the wearer's head. Also, a removable sweatband 23 is positioned in a channel formed in the front of the hat between a pair of parallel ridges 25 and 26 which are positioned one above the other as shown in FIG. 3A. The removable sweatband 23 is preferably formed of molded sponge or other suitable absorbent material and is held in place by being compressed between the two forward projections 20*a* and 20*b* and the parallel ridges 25 and 26 or other suitable means. Thus, it will be appreciated that the removable sweatband will be slightly longer than the distance around the perimeter of the hat between the adjacent projections 20*a* and 20*b* so that when positioned between the parallel ridges 25 and 26, it will be held in position in the hat A. However, it will be long enough to extend above both eyes of the wearer. Further, with this embodiment of the apparatus of the present invention, the ventilation passage 14' at the front of the cap A is provided with its own shade or bill 12' to prevent sun rays from directly entering the opening 14'.

Figure 4:
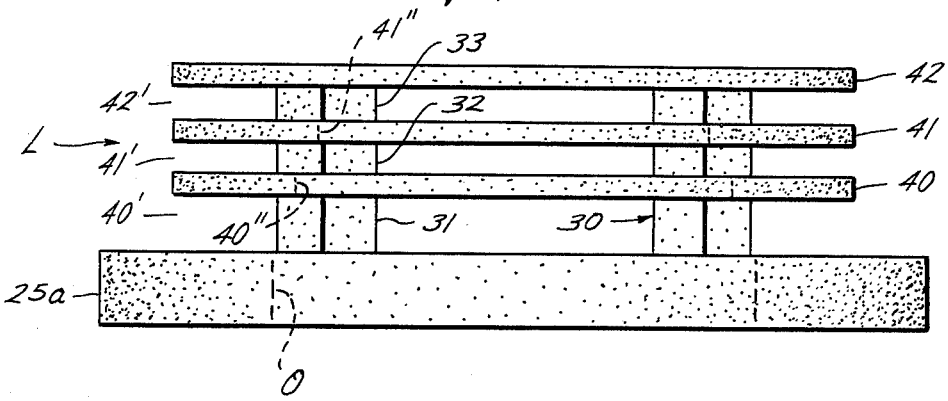
FIG. 4 is an elevational view of an alternate embodiment of the ventilated hat of the present invention showing a plurality of horizontally extending panels.
Figure 5:
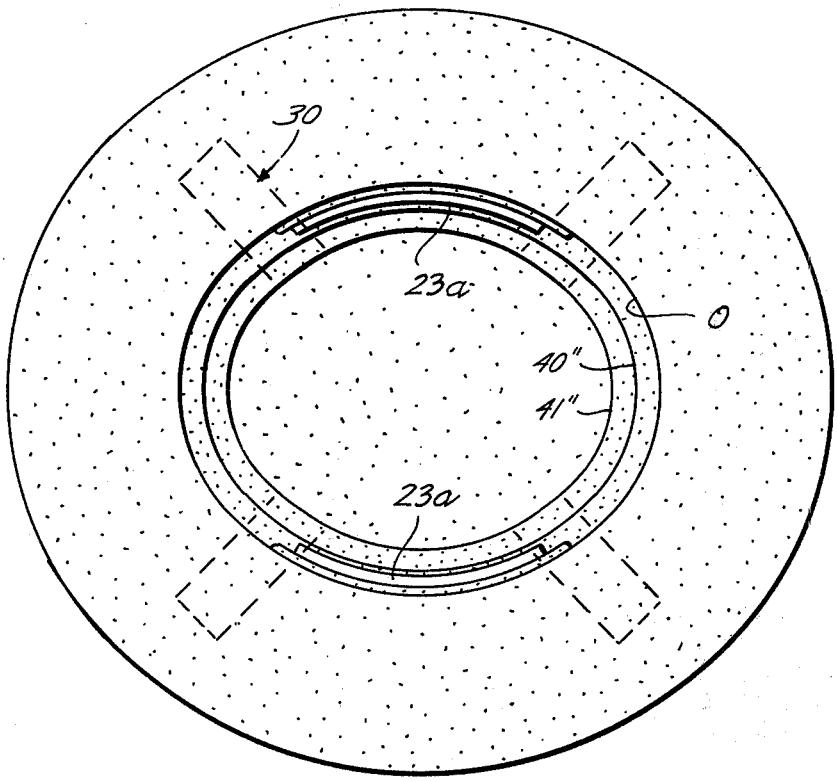
FIG. 5 is a bottom view of the hat shown in FIG. 4.

FIGS. 4 and 5 illustrate a layered hat designated generally L in the drawings. Such layered hat includes a substantially horizontally disposed brim 252 which has a plurality of vertically extending support members 30 positioned at circumferentially spaced points about the central opening O which receives the head of the wearer. As shown, the layers 40, 41 and 42 are essentially parallel to one another and to the brim 25 and are spaced vertically relative to each other so as to provide a plurality of air spaces 40', 41' and 42' between adjacent layers. As shown in FIGS. 4 and 5 of the drawings, the upper layers 40, 41 and 42 each have substantially the same or identical external circumferential configuration and thus are of substantially identical size. As shown in FIG. 5, the uppermost layer 42 is solid and does not have an opening extending therethrough. However, the intermediate layers 40 and 41 are each provided with openings which are of substantially the same shape as the opening O in the brim 25. Further, as shown in the drawings, the central opening 41'' in the layer 41 is slightly smaller than the corresponding central opening 40'' in the layer 40 therebelow. Further, it will be seen that the opening 40'' in the layer 40 is slightly smaller than the opening 0 in the brim piece 25.

Also, as shown in FIGS. 4 and 5 of the drawings, the vertical supports 30 consist of a plurality of vertical members 31, 32 and 33. The member 31 is slightly higher than the members 32 and 33 and thus provides a larger vertical space between the layer 40 and the brim 25. Further, as shown in the drawings, the members 30, 31 and 32 are generally rectangular in configuration and are disposed substantially radially with respect to the brim 25 and the layers 40, 41 and 42. It will be appreciated that the vertical spaces 40', 41' and 42' may be varied, as desired, to provide air spaces of any desirable size. However, as shown in the drawings, the width of each of the layers 40 and 41 between their respective central openings 40'' and 41'' and their outer perimeter is greater than the height of the gap or vertical space 40' or 41'. Thus, it will be appreciated that the various layers 40, 41 and 42 provide a sun shield to restrict direct contact of the sun's rays with the head of the wearer unless the sun rays should come horizontally from one side or the front or the back of the layered hat L. Further, it will be appreciated that with the layered hat L there are provided shaded ventilation openings throughout substantially the full circumference of the hat; with the exception, of course, of the spaces occupied by the vertical supports 31, 32 and 33.

Figure 6:
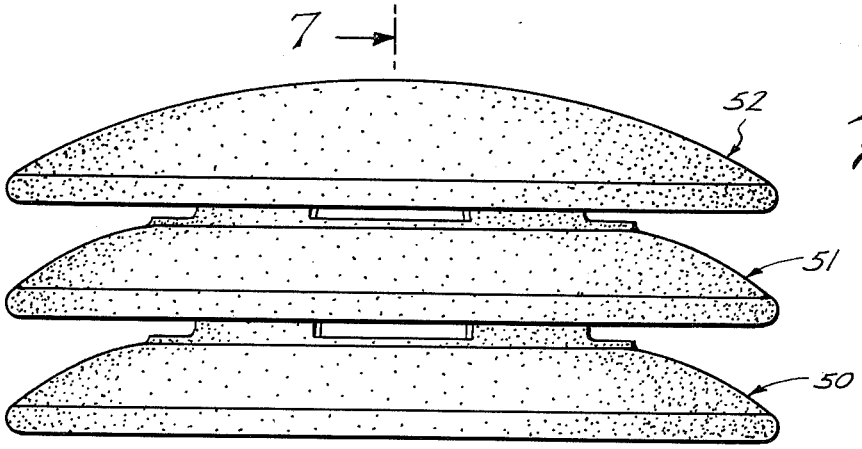
FIG. 6 is a side elevational view of a ventilated hat of the present invention.
Figure 7:
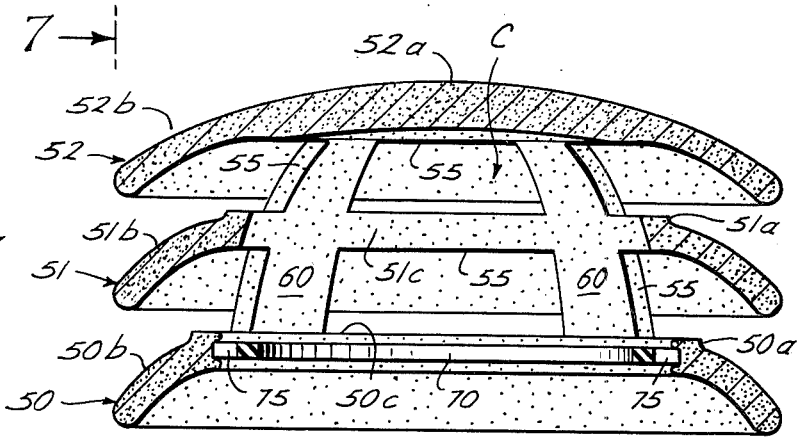
FIG. 7 is a view taken on line 7—7 of FIG. 6 showing additional details of construction of the embodiment shown in FIG. 6.
Figure 8:
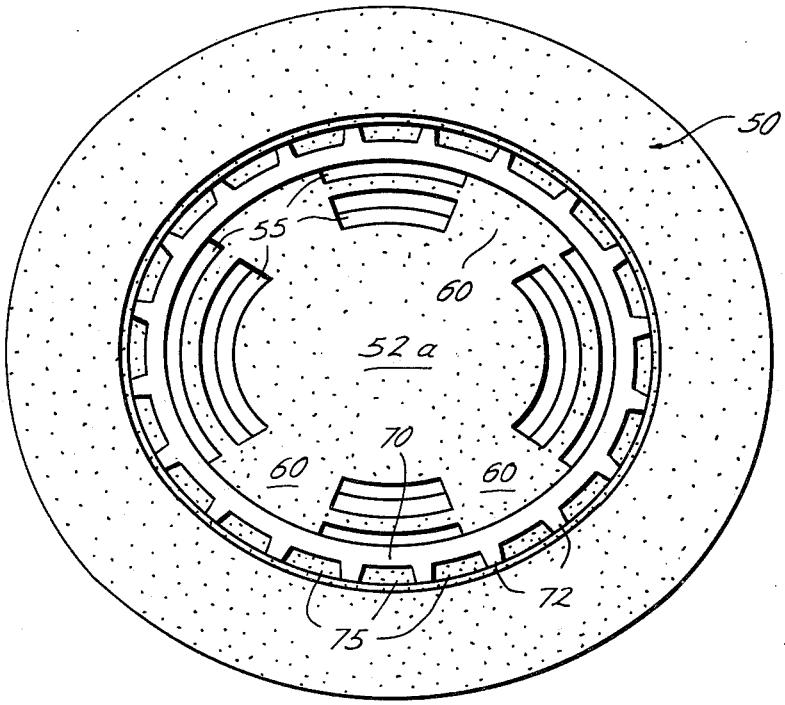
FIG. 8 is a bottom view of the FIG. 6 embodiment showing additional details of construction.

Considering now the embodiment of a layered hat L as illustrated in FIGS. 6, 7 and 8 of the drawings, such hat L comprises a brim portion 50 with a pair of layers 51 and 52 spaced vertically thereabove. These layers 51 and 52 may be of substantially the same size and shape as the brim portion 50 or, if desired, the lower brim 50 may have a larger circumference to better shade eyes, face, sides and back of neck. The layers 51 and 52 are supported above the brim portion 50 by a plurality of circumferentially spaced legs 60. The brim 50 and the layer 51 each has a substantially oval or elipse-shaped central portion **50*a* and 51*a*, respectively, from which projects or extends an outwardly and downwardly curved skirt portion 50*b* and 51*b*. The top member 52 has a solid top portion 52*a* which provides a continuous cover over the top of the head of the wearer and each of the brim 50 and the layer 51 are provided with central openings 50*c* and 51*c*, respectively, for receiving the head of the wearer. Also, as shown in the drawings, ventilation ports or passages 55 are formed between adjacent pairs of the support legs 60 to provide an opening through which air may pass to cool the head of the wearer. In this FIG. 6–8 embodiment of the apparatus of the present invention, the overhanging downwardly projecting skirts 50*b*, 51*b* and 52*b* extend around the entire circumference of the crown portion of the head cover which is formed by the upwardly and inwardly curved or inclined leg members 60. Further, it will be appreciated that direct sun rays may enter the crown portion, indicated generally C in the drawings, of this head cover only in the event the sun's rays enter from a position substantially horizontal from the sides, back or front of the head cover. The sun's rays which normally strike the head cover L would be reflected and would not enter directly into the crown portion C. Further, as shown in FIG. 8 of the drawings, a sweatband 70 is provided for securing the layered hat L to the head of the wearer. Such sweatband 70 comprises a continuous strip which engages the wearer's head and which is connected to the brim by a plurality of circumferentially extending elongated sweatband support and hold projections 72 which project radially outwardly from the inner surface of the opening 50*c* in the brim 50 to the inner surface of the sweatband 70. Such elongated projections are spaced circumferentially to provide circumferentially spaced gaps or passages 75** which provide a means for conducting additional air up, into and out of the crown of the hat around the head of the wearer.

Figure 9:
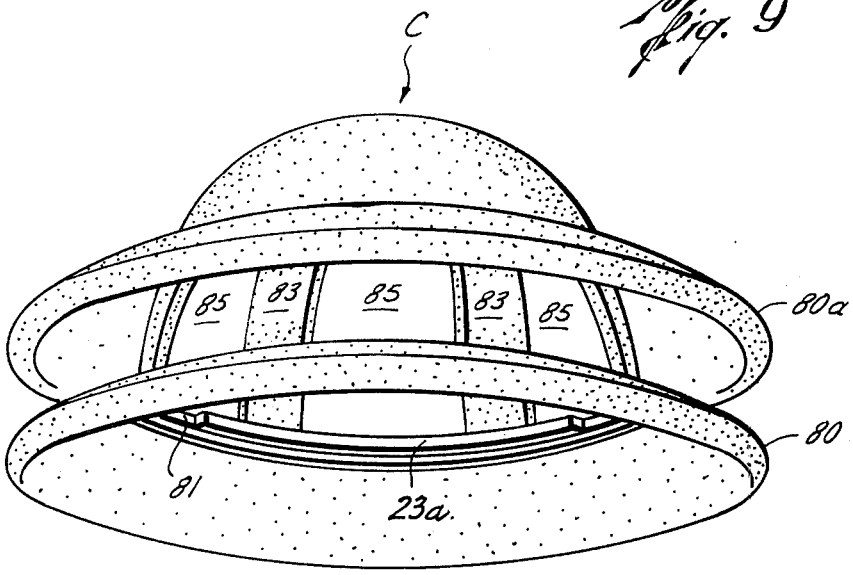
FIG. 9 is an isometric view of another embodiment of the ventilated hat of the present invention.
Figure 10:
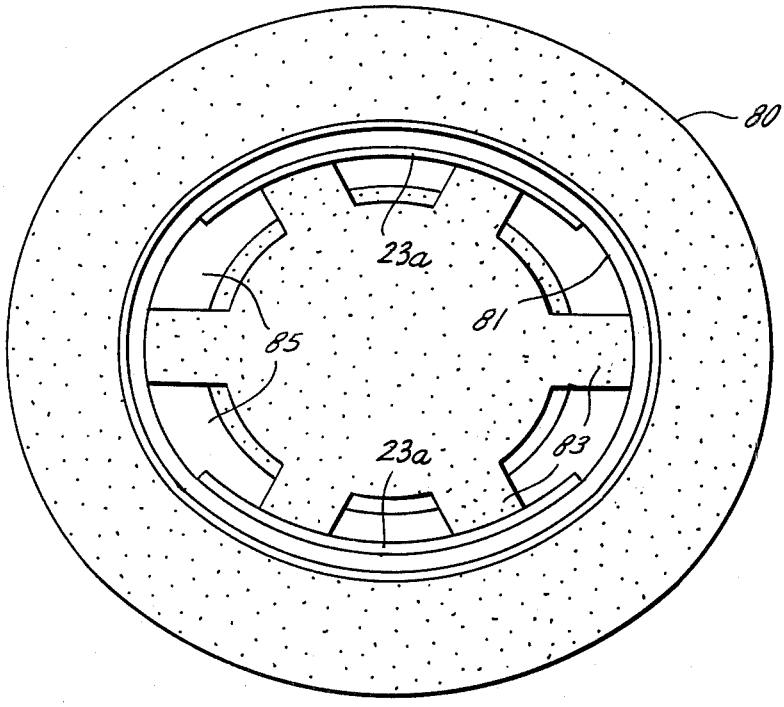
FIG. 10 is a bottom view of the FIG. 9 embodiment of the ventilated hat of the present invention.

Considering next the embodiment of the ventilated hat of the present invention illustrated in FIGS. 9 and 10 of the drawings, there is shown a hat having a central crown portion, indicated generally C, with a brim 80 extending circumferentially thereof and with an upper brim **80*a* positioned above the lower brim 80 and extending circumferentially around the crown C. As shown, the brims 80 and 80*a* are of substantially the same size and oval configuration. However, if desired, the lower brim 80 may have a larger circumference than the upper brim 80*a* and thus project further outwardly from the crown to better shade eyes, face, sides and back of neck. Further, as shown, a hatband area or portion 81 extends circumferentially around the head of the wearer. Sweatband 232 is provided for supporting the hat C on the wearer's head. Such sweatband 232 extends partway around the circumference of the hatband area 81** and may extend around the full circumference if desired.

A plurality of upwardly and inwardly curved legs 83 are provided at circumferentially spaced intervals around the circumference of the hatband portion 81 for supporting the upper brim **80*a* and also for forming a plurality of circumferentially spaced air passages or vents 85** which permit air to circulate in, across, around and out of the crown portion C.

As shown, the brim **80*a* extends outwardly and downwardly from its point of attachment to the crown C and similarly the brim 80 extends outwardly and downwardly from the hatband area 81** to provide a pair of substantially parallel skirts or bills that extend around the circumference of the head cover for preventing the sun's rays to directly contact the head of the wearer.

All head covers with 360° bottom brims circumventing the lower part of the crown, will have one or more brims above the bottom brim. They may all be the size, configuration and circumference as the bottom brim or may all have the same configuration as the bottom brim, but smaller in size and circumference, or each ascending brim above the bottom brim may have the same configuration as the bottom brim, but smaller in circumference than the preceding brim. Thus appearing tapered in steps and will provide the cooling and shading effects described herein with appropriate width of brims and vertical space between brims maintained.

It will be appreciated that the various embodiments of the ventilated hat of the present invention may be formed of hard material, such as plastic or metal or a lightweight plastic foam material, such as styrofoam or the like, which provides a waterproof insulation material for keeping the wearer's head cool and dry. Further, it will be appreciated that hats may be molded of any material so they are made of an integral one-piece construction of assembled components, or the head covers may be woven or stamped or otherwise formed or made of any suitable or conventional hat material. It will be appreciated that any of the sweatbands shown and described herein may be used with any of the head cover devices shown and described in this specification and drawings.

Thus, it will be appreciated that the head cover of the present invention provides a head cover to expose a large area of the head or hair directly to air and provide a large amount of air circulation between the head and head cover while preventing the sun rays from directly entering the air openings and striking the head or hair except when the head piece is tilted or the sun is close to the horizon and the effect of the sun rays are weak.

The foregoing disclosure and description of the invention are illustrative and explanatory thereof, and various changes in the size, shape and materials as well as in the details of the illustrated construction may be made without departing from the spirit and scope of the invention.

What is claimed is:

1. A ventilated head cover, comprising:
(a) a head cover having a crown portion for surrounding and covering a person's head;
(b) a plurality of ventilation openings in the sides and front and back of the crown to allow air to freely circulate around and across the head through such crown, such openings being positioned on opposite sides of the crown so as to provide a substantially straight through-flow path for the circulation of air into the crown from one side and out of the crown on the opposite side or from front to back; and
(c) sweatband means secured to the crown for positioning the head cover on a wearer's head, such sweatband means including a plurality of circumferentially spaced ventilation passages for permitting the flow of air between the wearer's head and the crown to further facilitate the flow of air up, into and out of the crown, wherein the crown is provided with a pair of outwardly and downwardly projecting bills positioned above and below the front opening for shading the opening and the face of the wearer, respectively.

2. A ventilated head cover, comprising:
(a) a head cover having a crown portion for surrounding and covering a person's head;
(b) a plurality of ventilation openings in the sides and front and back of the crown to allow air to freely circulate around and across the head through such crown, such openings being positioned on opposite sides of the crown so as to provide a substantially straight through-flow path for the circulation of air into the crown from one side and out of the crown on the opposite side or from front to back; and
(c) sweatband means secured to the crown for positioning the head cover on a wearer's head, such sweatband means including a plurality of circumferentially spaced ventilation passages for permitting the flow of air between the wearer's head and the crown to further facilitate the flow of air up, into and out of the crown, wherein the crown is provided with a downwardly projecting bill positioned in front of the head of the wearer and a circumferentially extending shade extending around the crown so as to shade the sides, front and back of the head.

3. A ventilated head cover, comprising:
(a) a head covering having a crown portion for surrounding and covering a person's head;
(b) a plurality of ventilation openings in the sides and front and back of the crown to allow air to freely circulate around and across the head through such crown, such openings being positioned on opposite sides of the crown so as to provide a substantially straight through-flow path for the circulation of air into the crown from one side and out of the crown on the opposite side or from front to back; and
(c) a pair of substantially parallel ridges in the crown for receiving a removable sweatband formed of absorbent material which will absorb moisture and which may be rinsed out and squeezed dry.

4. A ventilated hat structure, comprising:
(a) a substantially flat brim having a central opening for receiving a person's head;
(b) a plurality of flat oval rings positioned at spaced intervals above said brim and having central openings therein aligned with the central opening on said brim; and
(c) an oval top positioned above the upper oval ring to provide a top for the hat structure.

5. The invention of claim 4, wherein:
the oval rings have a width around the central opening greater than the distance between adjacent rings or between the brim and the first adjacent ring thereto.

6. A ventilated hat structure, comprising:
(a) a plurality of oval rings stacked one above another and connected together by circumferentially spaced upwardly and inwardly curved legs wherein the lowermost ring has an oval opening for receiving a person's head and the uppermost ring has a solid center for covering the top of a person's head; and
(b) wherein each of said rings is curved outwardly and downwardly from said circumferentially spaced legs to provide a sun shade around the perimeter of the hat.

7. The invention of claim 6, wherein:
an intermediate ring is provided between the uppermost and lowermost rings and wherein said intermediate ring is provided with a central opening which is smaller than the central opening of the lowermost ring.

8. The invention of claim 3, wherein:
said ventilating passages are between the wearer's head and the sweatband.

* * * * *

UNITED STATES PATENT AND TRADEMARK OFFICE

CERTIFICATE OF CORRECTION

PATENT NO. : 4,114,201

DATED : September 19, 1978

INVENTOR(S) : Harold K. Garrison

It is certified that error appears in the above-identified patent and that said Letters Patent are hereby corrected as shown below:

Column 3, line 1, change "252" to --25a--.

Column 3, lines 6, 17, 22, 28 and 31, change "25" to --25a--.

Column 3, line 22, in "opening 0", change the numerical "0" to an alphabetical "O".

Column 4, lines 42 and 43, change "232" to --23a--.

Column 5, line 13, change "construction of" to --construction or--.

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*